United States Patent [19]

Curati, Jr.

[11] 4,366,846

[45] Jan. 4, 1983

[54] METHOD FOR COLLECTING AND STORING LIQUID FROM ALONG A RAILROAD TRACK SECTION

[75] Inventor: Marino Curati, Jr., Geneva, Ohio

[73] Assignee: True Temper Corporation, Cleveland, Ohio

[21] Appl. No.: 290,481

[22] Filed: Aug. 6, 1981

Related U.S. Application Data

[62] Division of Ser. No. 53,705, Jun. 29, 1979, Pat. No. 4,299,697.

[51] Int. Cl.[3] ..... B65B 3/04

[52] U.S. Cl. ..... 141/1; 210/747; 238/2; 404/2; 404/4; 405/36; 405/53

[58] Field of Search ..... 141/1, 10, 114, 313–317, 141/18, 2; 210/170, 513, 538, 747, 532.1; 238/2, 3, 4, 5, 6, 7; 405/36, 50, 53; 404/2, 3, 4; 104/133; 134/123

[56] References Cited

U.S. PATENT DOCUMENTS

| | | | |
|---|---|---|---|
| 679,536 | 7/1901 | McCann | 210/170 |
| 1,081,515 | 12/1913 | Reinohl | 75/86 |
| 1,397,452 | 11/1921 | Reed | 210/170 |
| 2,492,177 | 12/1949 | Olsen | 238/7 |
| 3,474,625 | 10/1969 | Draper et al. | 61/1 |
| 3,505,820 | 4/1970 | Draper et al. | 405/53 |
| 3,587,964 | 6/1971 | Cork | 238/2 |
| 3,705,851 | 12/1972 | Brauer | 405/36 |
| 3,754,362 | 8/1973 | Daimler et al. | 405/36 |
| 3,773,255 | 11/1973 | Schoulties et al. | 238/2 |
| 3,795,180 | 3/1974 | Larsen | 405/36 |
| 3,854,291 | 12/1974 | Perkins | 210/170 |
| 3,872,007 | 3/1975 | Holland | 210/170 |
| 3,936,380 | 2/1976 | Boske | 210/170 |
| 4,010,896 | 3/1977 | Stockton | 238/2 |
| 4,039,451 | 8/1977 | Smith | 210/170 |
| 4,045,964 | 9/1977 | Barclay | 405/50 |
| 4,193,873 | 3/1980 | Throsher | 210/170 |

*Primary Examiner*—Houston S. Bell, Jr.

*Attorney, Agent, or Firm*—Baldwin, Egan, Walling & Fetzer

[57] ABSTRACT

A containment and storage system for liquids, such as petroleum based liquids, for use for instance in a railroad track environment, comprising a walled containment reservoir formed in the ground and opening upwardly, with the containment reservoir including a flexible impervious liner to prevent escape of liquid through the liner from the containment space, and a receiving or storage reservoir disposed in spaced relation to the containment reservoir and means coacting between the reservoirs for transferring liquid caught in the containment reservoir, to the storage reservoir. In one embodiment, a mechanical pump is utilized for transferring to the storage reservoir liquid caught in the containment reservoir. In another embodiment, gravity flow is utilized for transferring such liquid. An improved arrangement is disclosed for handling liquid caught in the containment reservoir, and preventing leakage from the reservoir, at the exit point from the containment reservoir. A novel method of collecting and storing liquids, such as petroleum based liquids, along a railroad track environment, is also disclosed.

9 Claims, 23 Drawing Figures

10"
132
36"
22
21
64'
136
66
16
130
38
24'
20
18
26
28
32
134
135
140
142

METHOD FOR COLLECTING AND STORING LIQUID FROM ALONG A RAILROAD TRACK SECTION

This is a divisional application of applicant's copending patent application Ser. No. 53,705 filed June 29, 1979, now U.S. Pat. No. 4,299,697.

This invention relates in general to a system for collecting and storing liquids, such as petroleum based liquids, and more particularly to a containment and storage reservoir system, for a railroad track section, formed by lining an earthen containment space or pit with a liquid impervious liner, to form a containment reservoir, and providing means for transferring liquid caught in the containment reservoir, to a storage reservoir, with the liner preventing escape of the liquid into adjacent land areas.

BACKGROUND OF THE INVENTION

In U.S. patent application Ser. No. 5,699 filed Jan. 23, 1979 in the name of Robert W. Luebke, and now U.S. Pat. No. 4,296,884, and entitled Containment Reservoir and Method, there is disclosed a reservoir arrangement formed with a flexible liner laid in an earthern containment space for catching petroleum based liquids discharged from railroad vehicles, such as diesel locomotives, on a railroad track section. The present invention provides an improvement over the arrangement and method disclosed in Ser. No. 5,699, now U.S. Pat. No. 4,296,884.

SUMMARY OF THE INVENTION

The present invention provides a collecting and storage system in a railroad environment, and a method, for liquids such as petroleum oils or the like, and which can be expeditiously made and installed in any size, desired, with the system including a containment reservoir and a storage reservoir, with means coacting between the reservoirs for transferring liquids caught in the containment reservoir to the storage reservoir. The reservoirs are formable utilizing an earthern space or pit, including a liquid impervious liner generally following the contour of the earthen space or pit. The liner resists or prevents escape of collected liquids from the respective reservoir into adjacent land areas. This is an improved arrangement of reservoir system as compared to that disclosed in the aforementioned pending U.S. patent application Ser. No. 5,699, now U.S. Pat. No. 4,296,884 with the present system possessing various additional features.

Accordingly, an object of the invention is to provide a novel reservoir system for catching and for storing liquid such as petroleum based oils.

A further object of the invention is to provide a system of the above type which includes a containment reservoir having a liquid impervious liner, and a storage reservoir spaced from the containment reservoir, together with means coacting between the reservoirs for transferring liquid caught or trapped in the containment reservoir into the storage reservoir.

A still further object of the invention is to provide a reservoir system which includes means filtering the caught liquid in th containment reservoir, prior to its being removed from the containment reservoir into the storage reservoir, and with means for aiding in preventing inadvertent loss of liquid into the adjacent land areas.

A still further object of the invention is to provide a reservoir system of the above described type in conbination with a railroad track system section which includes longitudinally extending rails and transversely extending ties supporting the rails, with the containment space of the containment reservoir having a layer of ballast material disposed therein, with the ties being supported on the ballast material, and having a layer of pervious fabric material covering the containment space of the containment reservoir, and resting on the top of the ballast material, which pervious layer permits the passage of liquids therethrough while filtering the same.

A still further object of the invention is to provide a novel method of forming a containment and storage system of fabric lined earthen reservoirs.

Other objects and advantages of the invention will be apparent from the following description taken in conjunction with the accompanying drawings, wherein:

BRIEF DESCRIPTION OF THE DRAWINGS

FIG. 8 shows the coated fabric forming the end wall of the impervious liner for the adjacent containment reservoirs in place, and FIG. 9 illustrates the ballast having been moved into engagement with such end walls of coated fabric, to form the respective containment space for the reservoirs.

DESCRIPTION OF PREFERRED EMBODIMENTS

Referring now again to FIGS. 1 and 2 there is illustrated, a plan view of the system for catching and storing liquids in accordance with the invention, and comprising a containment reservoir 10, a storage reservoir 12 (FIG. 2) and means coating between the containment reservoir and the storage reservoir for transferring liquid caught by the containment reservoir to the storage reservoir. The containment reservoir is shown in combination with a railroad track section 16 (FIG. 1) which overlies the containment reservoir 10 so that any liquid dripping down on spilled from railroad vehicles passing over or parked on track section 16, will be caught in the embodiment reservoir for subsequent handling, as will be hereinafter described.

Figure 1:
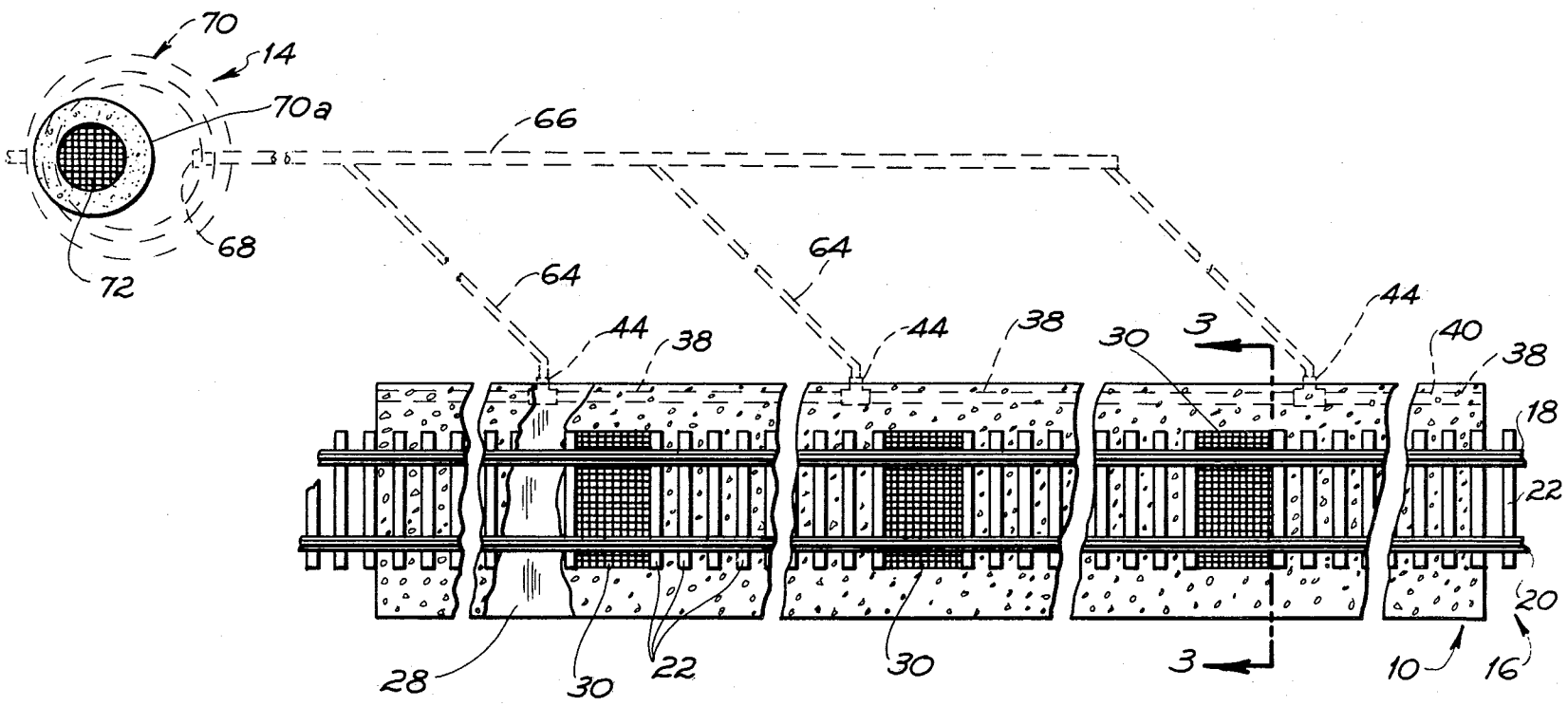
FIG. 1 is a top plan, broken, fragmentary view of a reservoir system including a containment reservoir in combination with a railroad track section, formed in accordance with the invention, but not showing the storage reservoir of the system.

The railroad track section 16 comprises spaced rails 18 and 20 (FIG. 1) which are supported in the conventional manner on ties 22 which in this case are shown as being wood ties. However, any suitable type of tie structure including concrete ties may be utilized. As can be seen in FIG. 1 the containment reservoir 10 extends beneath and laterally of track section 16, and opens upwardly and encompasses the railroad track section for a predetermined portion of the length thereof. Only one containment reservoir is illustrated in FIG. 1 but it will be undersood that a plurality of the containment reservoirs could be provided in tandem relationship with respect to one another along a track section for increasing the lengthwise dimension of containment reservoir structure, and as will be hereinafter described in greater detail in connection with FIGS. 8 and 9 of the application drawings.

The containment reservoir illustrated comprises a pit or excavation defining a containment space covered or lined with a flexible liner 24 (FIG. 3) which is impervious to passage of liquid therethrough from the containment reservoir into the surrounding ground area. The liner may be of the type disclosed in the aforementioned U.S. patent application Ser. No. 5,699 in the name of Robert W. Luebke, now U.S. Pat. No. 4,296,884, and reference may be had to such patent application for a detailed description of suitable construction of such liner. In any event, the liner prevents the escape of liquid caught in the containment reservoir from seeping or escaping into the adjacent ground area, and in the manner described, for instance, in aforementioned Ser. No. 5,699, now U.S. Pat. No. 4,296,884. The impervious layer 24*a* (FIG. 3) of the liner in this embodiment preferably faces inwardly, as shown. However, such layer 24*a* could face outwardly.

The contaiment reservoir is preferably completely filled with lump-like material, such as railroad bed ballast comprising stones or the like, conventionally utilized in conjunction with railroad track installations. Such ballast bed has little if any fines, to aid in preventing clogging of the bed, and will readily pass therethrough liquid caught by the containment reservoir.

Figure 3:
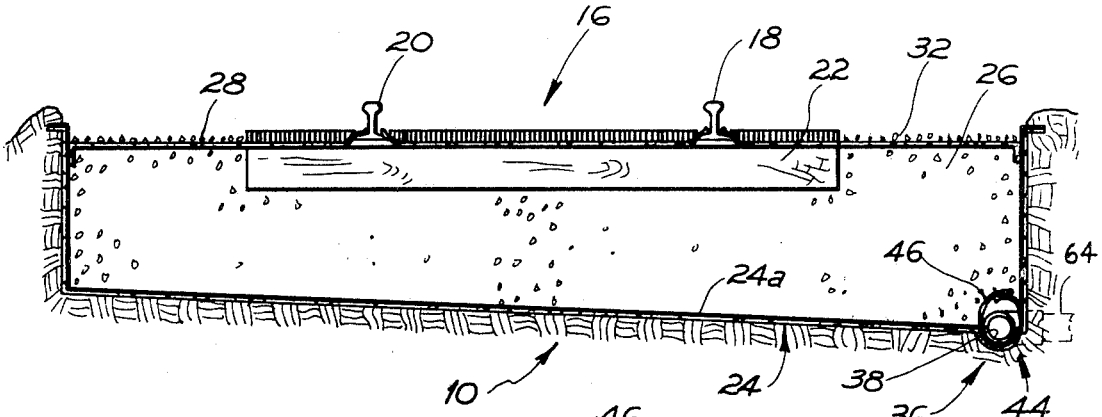
FIG. 3 is an enlarged vertical, transverse sectional view of the containment reservoir of FIG. 1, taken generally along the plane of line 3—3 thereof, looking in the direction of the arrows.
Figure 4:
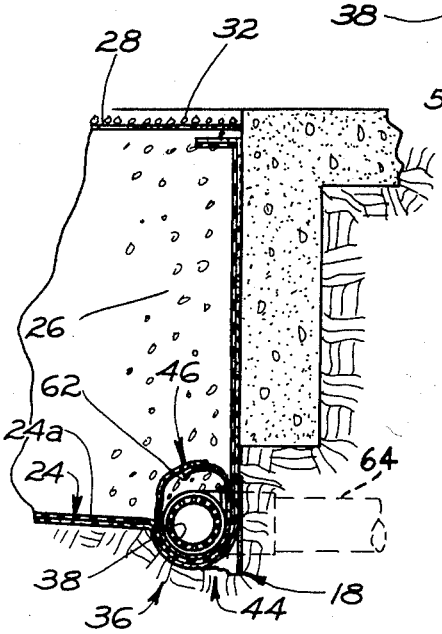
FIG. 4 is an enlarged, fragmentary, transverse sectional view illustrating a portion of the side structure of a different arrangement or embodiment of the containment reservoir of FIG. 3, and more particularly a side structure formed at least in part of concrete instead of earth.

The ties 22 as can be best seen in FIG. 3, are embedded in the ballast bed 26, and thus are held in predetermined position and support the track members 18 and 20 thereon with the track members being connected or coupled to the ties 22 in any suitable or conventional manner.

The top of the containment reservoir may be covered by a layer 28 of pervious fabric material, such as the non-woven fabric identified in aforementioned U.S.

patent application Ser. No. 5,699, now U.S. Pat. No. 4,296,884 with such upper layer 28 extending between the rail members 18 and 20 and laterally of the respective rail member to the exterior side boundry of the containment reservoir. The pervious layer 28 of material is maintained in place, and may be weighted down or held in place intermediate the rail members and on either lateral side thereof for predetermined distance outwardly therefrom, by a relatively thin layer 32 of aggregate material such as the aforementioned ballast material or some other porous material for aiding in weighing the porous fabric layer 28 down against the underlining ballast layer. Metal grating sections 30 may be spaced along the track as shown in FIG. 1, providing safe footing areas, and aiding in holding down the underlying pervious layer 28. As liquid, such as petroleum based fuel drips down from, say for instance diesel locomotive on the track section 16, such liquid will pass through the grating 30 or through the particle weigh down layer 32, then through the porous underlying fabric layer 2 in the ballast filled reservoir, where the oil will drain down to drain section 36 (FIGS. 3 and 6) where it is adapted to be removed from the containment reservoir.

Drain section 36 in the embodiment illustrated, comprises lengthwise or longitudinally extending perforated pipe sections 38 which are layed in a depression or recess 40 extending in the embodiment illustrated along one side wall 41 of the containment reservoir, as best seen for instance in FIGS. 1 and 3. The liner 24, forming the containment reservoir bottom and side surfaces, as can be best seen in FIG. 6, extends about the lower portion of the perforated pipe 38 and then upwardly to form the adjacent side wall 41 of the containment reservoir. Pipe sections 38 as aforementioned are perforated along their lengthwise and circumferential extends as at 42, with liquid caught in the containment reservoir draining into the perforated pipe sections from whence it is removed from the containment reservoir via T connections 44, spaced along the perforated pipe sections 38 and coupled therewith. Pipe sections 38 may be formed of for instance plastic, or any suitable material, with polyvinylchloride (PVC) plastic being suitable.

In order to prevent or at least materially delay fines and the like which may be carried into the containment reservoir with the liquid from the overhead track section, from clogging the perforated pipe 38, there may be provided in accordance with the invention a filter layer or envelope 46 of porous fabric material generally encompassing the perforated pipe 38 and T couplings thereof, for preferably the full lengthwise extent of the pipe sections 38, and which in the embodiment illustrated is coupled by means of a fastening arrangement 48 at each T connection 44, so that liquid draining down into the perforated pipe is generally filtered, so as to prevent the accumulation of fines into the perforated pipe sections 38. Filter envelope 46 may be comprised of the same porous fabric material that forms the upper layer 28 covering the containment reservoir.

Fastening arrangements 48 at the location where each of the T couplings 44 extend through the liner wall of the containment reservoir also provide a sealing arrangement, so as to prevent liquid in the reservoir from inadvertently seeping or flowing out of the containment reservoir along the exteriors of the T connections.

Figure 6A:
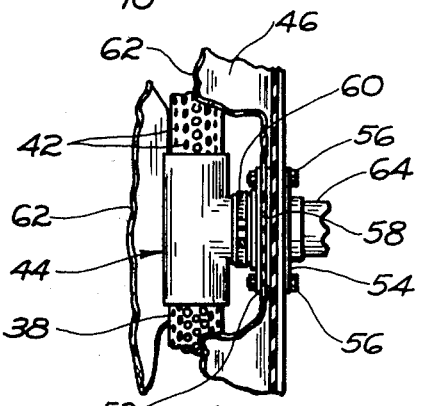
FIG. 6A is a reduced size, fragmentary, horizontal sectional view of the drain of FIG. 6, at one of the T-coupling connections.
Figure 6:
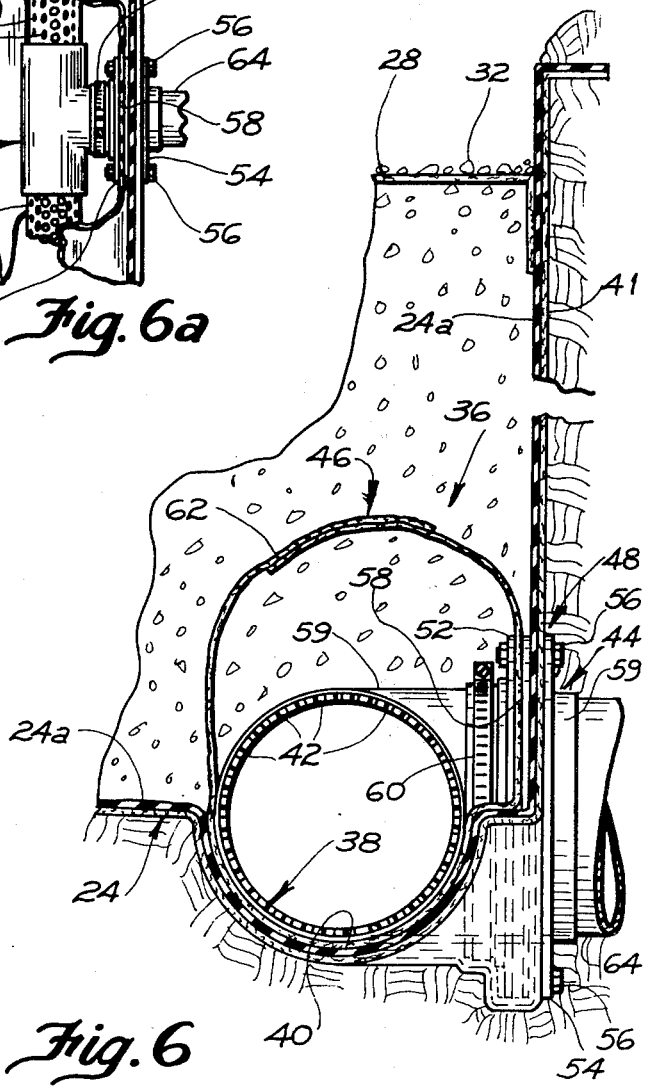
FIG. 6, is an enlarged, fragmentary, detailed view of the exit or drain from the containment reservoir of the system of FIGS. 1 and 2, and illustrating the arrangement of liquid pervious fabric which encompasses the perforated drain pipe utilized in the bottom of the containment reservoir, for removing caught liquid therefrom and passing it exteriorly of the containment reservoir, to the storage reservoir.

Such sealing arrangement comprises a pair of spaced rings or apertured plates 52, 54 respectively disposed interiorly and exteriorly of the reservoir wall, and connected by threaded fastener means 56, with the side of the impervious fabric liner 24 being received and clamped between the rings, in tight sealing relationship. There is also provided a rubber or neoprene flanged sleeve 58, coacting with and extending between the clamping rings 52, 54 and the exterior surface of the adjacent T coupling section 59, which extends through a complementary opening provided in the liner side wall 41. Sleeve 58 is clamped to the exterior of the T coupling section 59 as by means of a metal or plastic ring clamp 60, thus, insuring that liquid passing through filter layer or envelope 46 and into the perforated pipe 38 can not run along the exteriors of the T couplings 44 and escape from the containment reservoir into the adjacent ground areas. Ballast is filled into the envelope 46 about pipe 38 prior to losing or overlapping the seam thereof as at 62, after which the remainder of the containment space of the containment reservoir 10 is filled with ballast or lump material as shown in FIGS. 3 and 6.

Figure 7:
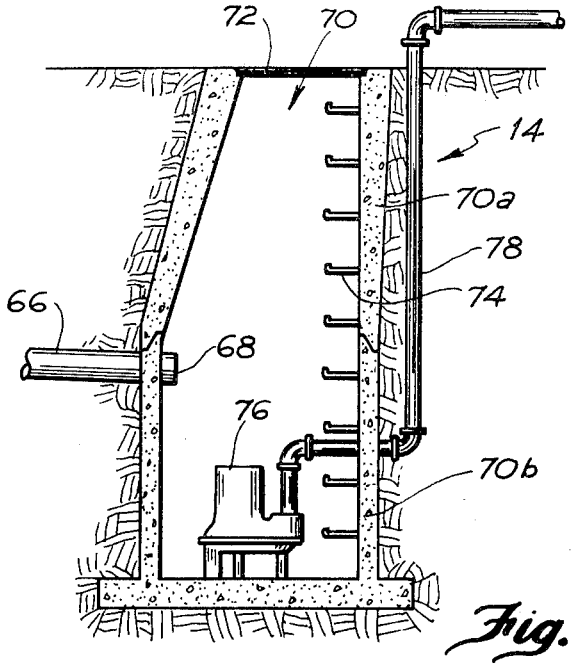
FIG. 7 is a vertical, sectional view, illustrating a sump pit means shown in the FIGS. 1 and 2 reservoir system, coacting between the containment reservoir and storage reservoir, for transferring liquid caught by the containment reservoir to the storage reservoir.

The T couplings 44 are coupled as by means of pipe section 64 which form passageways to a main or common pipe or passageway 66 which in turn extends into communication as at 68 (FIG. 7) with a sump well or pit 70. Pipe sections 64 and 66 are arranged to provide gravity flow of liquid therethrough.

Well 70 is lined with some suitable liquid impervious material and in this instance being shown lined with precast concrete sections 70*a*, 70*b*, so that the liquid as it drains from the containment reservoir 10 by gravity, flows into the well 70, until removed as will be hereinafter described. The well 70 is preferably covered by means of a manhole cover 72, with a ladder 74 being provided for providing ready access into the bottom of the well.

Figure 2:
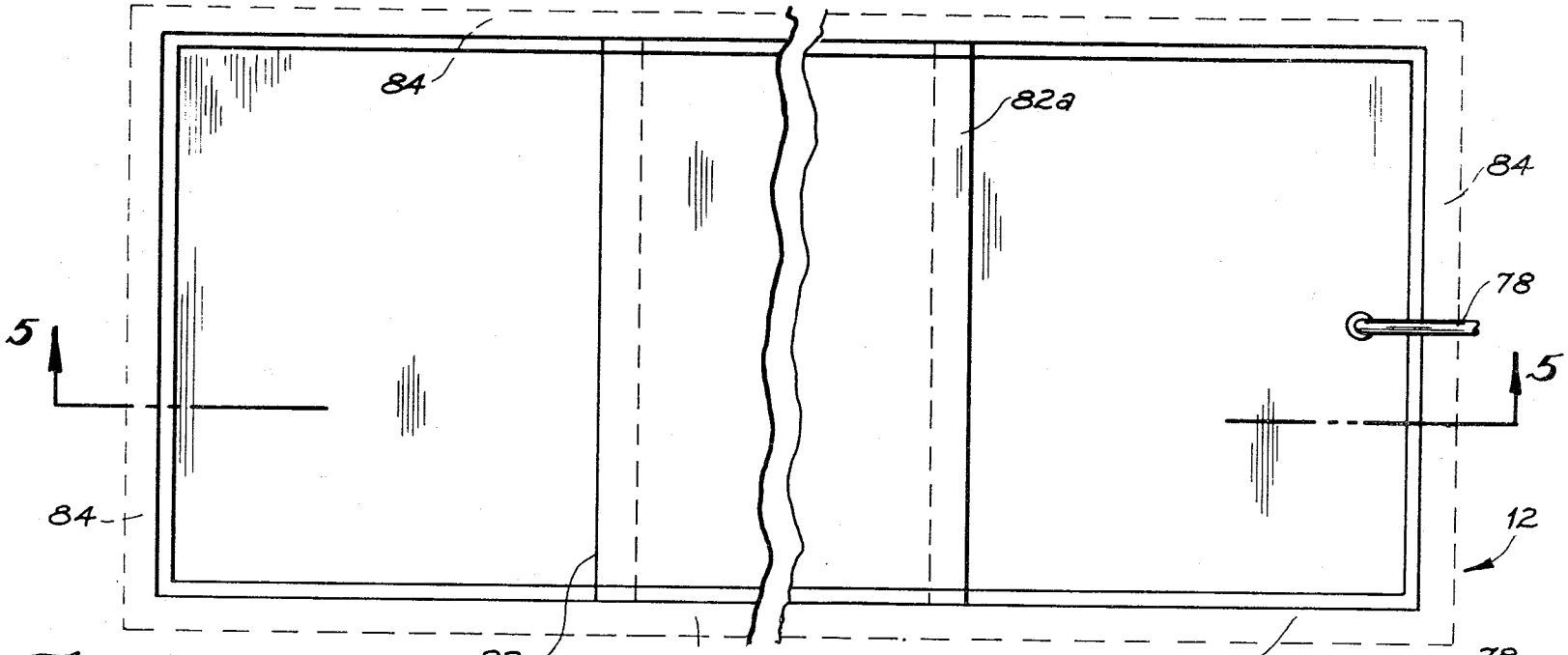
FIG. 2 is a broken to plan view of the storage reservoir for the system of the invention.

A submergible preferably electrical drain pump 76 is positioned in the well bottom, and is coupled by means of piping 78 to storage reservoir 12 (FIG. 2). Liquid from the well 70 is pumped by pump 76 into the storage reservoir, with actuation and deactuation of such pump preferably occurring automatically upon rising and falling of the liquid in the well to a predetermined level.

Figure 5:
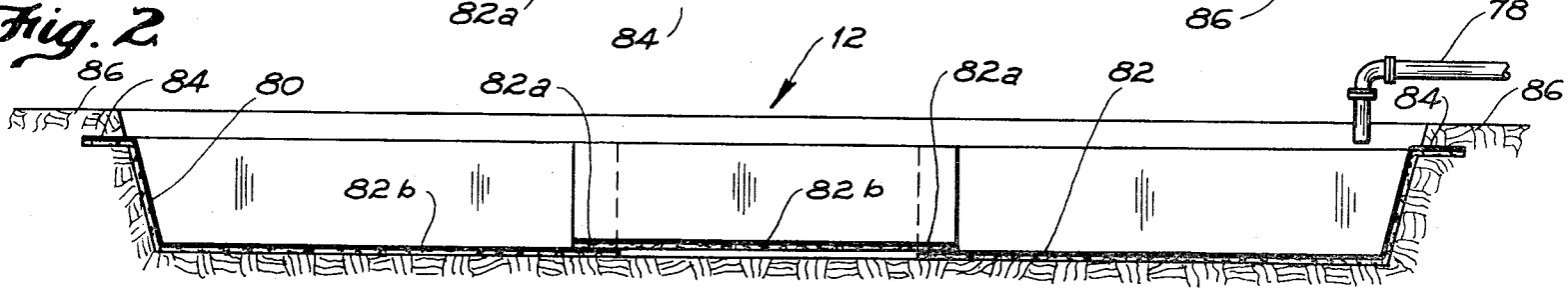
FIG. 5 is a lengthwise sectional view taken generally along the plane of line 5—5 of FIG. 2 of the storage reservoir portion of the system (illustrted in FIGS. 1 and 2).

The storage reservoir 12 in the embodiment illustrated in FIGS. 2 and 5 comprises a ground pit or excavation 80 in which a flexible liquid impervious liner 82 has been laid, with the liner preferably being formed of the material aforedescribed in conjunction with the liner of the containment reservoir 10. As can be seen in FIG. 5 the liner 82 may be formed of a plurality of strips of the liquid impervious material overlapped, as at 82*a* and sealed or attached together as by means of known adhesive materials. Reference may be had to the aforementioned U.S. patent application Ser. No. 5,699 for a more complete disclosure of a suitable liner material and its construction.

In any event, the storage reservoir is comparatively readily formed, is open at its top as shown, and with the pipe 78 from the pump 76 in well 70 (FIG. 7) extending into discharge coaction with the storage reservoir, as shown in FIGS. 2 and 5, for transfer of the liquid from the containment reservoir into the storage reservoir. The upper ends 84 of the side wall sections of the liner 82 in the storage reservoir are preferably weighted down by the earth portions 86 as shown in FIG. 5, thus anchoring the liner in the earthen pit 80 and preventing its shifting. While the liner has been shown for illustrative purposes in spaced relation to at least a portion of the defining earthen surfaces of the pit, (i.e. the middle portion) it will be understood that in an actual installation, the liner 82 is supported by such earthen surfaces and is in engagement therewith. While the rubberized layer 82*b* of the liner is shown as facing inwardly, the liner may be reserved so that layer 82*b* faces outwardly and engages the earthen surfaces of the receiving pit.

Figure 11:
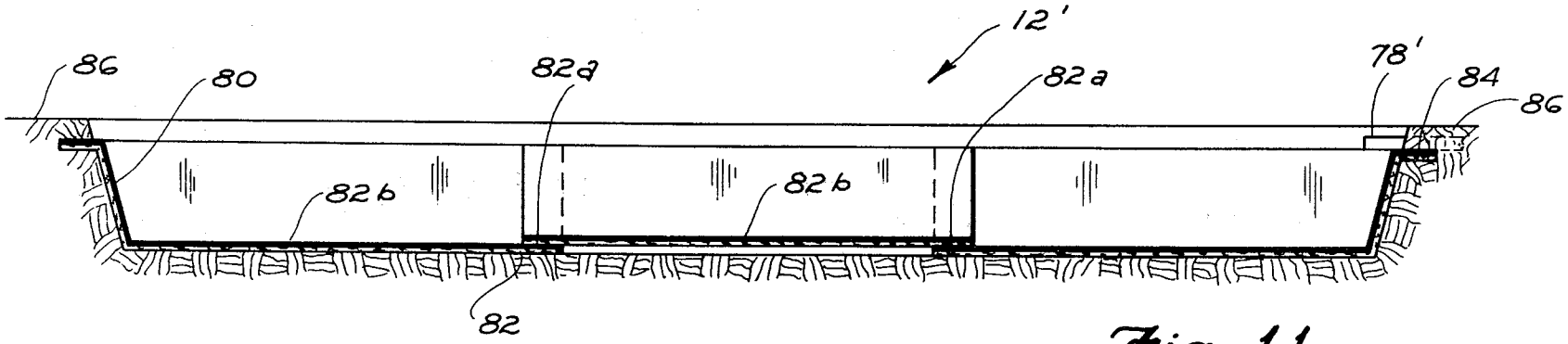
FIG. 11 is a lengthwise cross sectional view showing a storage reservoir formed generally similar to that illustrated in FIG. 5 but wherein gravity flow is utilized to transfer liquid caught in the containment reservoir to the storage reservoir rather than a pump means as is illustrted in FIG. 7.
Figure 12:
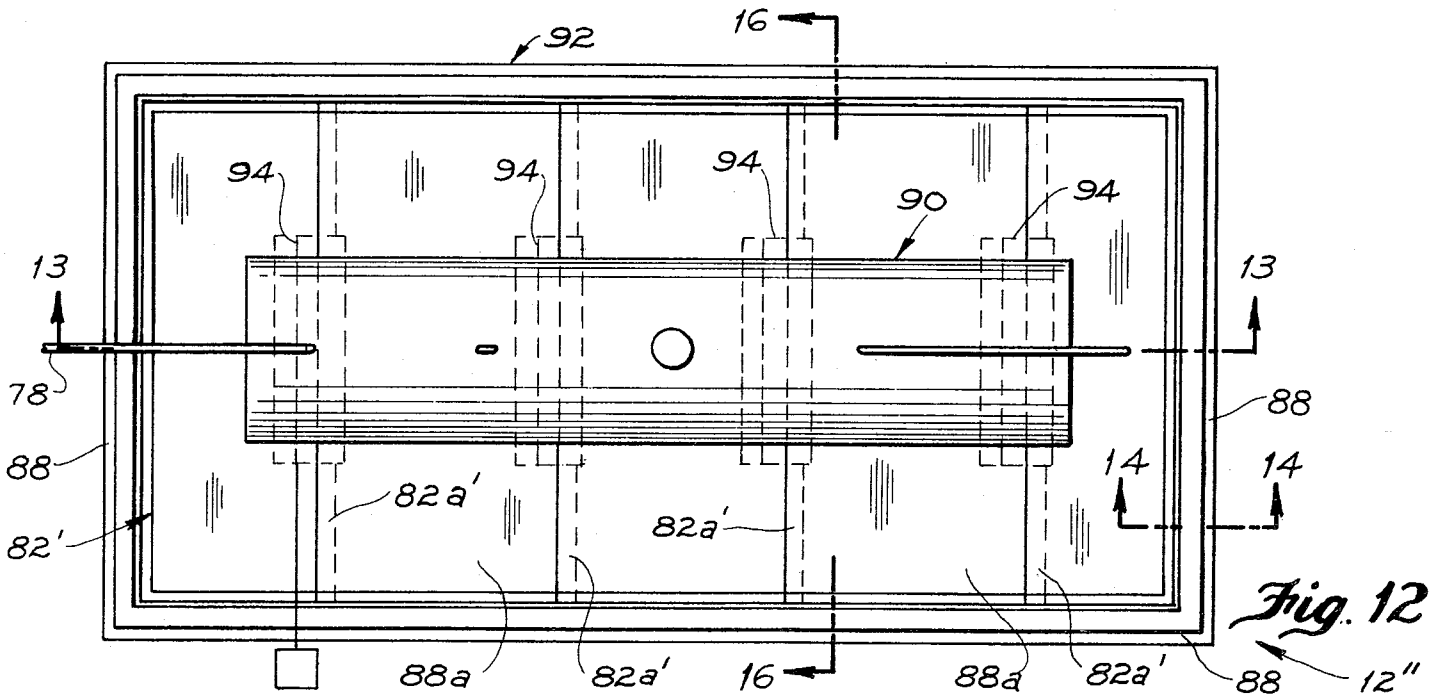
FIG. 12 is a top plan view of another form of storage reservoir, and one utilizing a tank structure which is surrounded by a dike formed from an earthen wall defining a containment space lined with an impervious fabric material liner.
Figure 13:
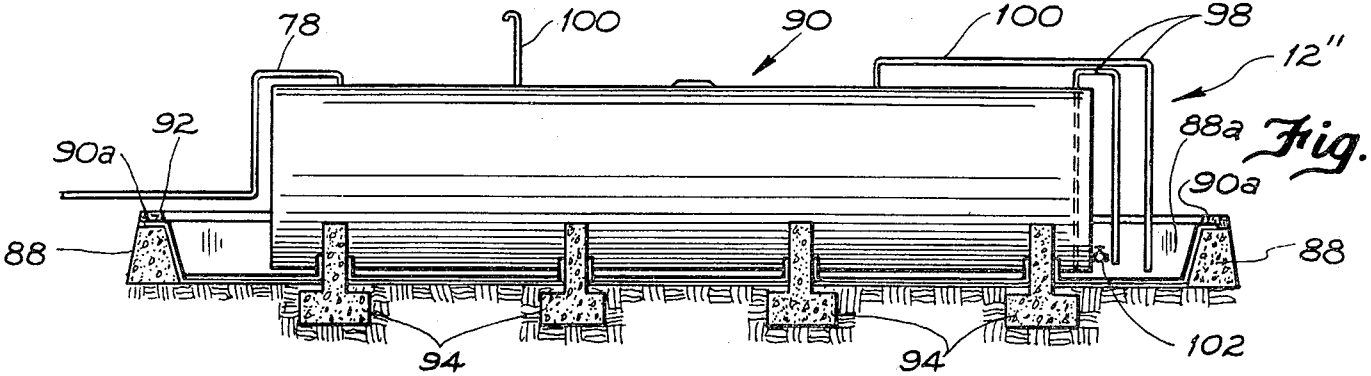
FIG. 13 is a sectional view taken generally along the plane of line 13—13 of FIG. 12 looking in the direction of the arrows.
Figure 14:
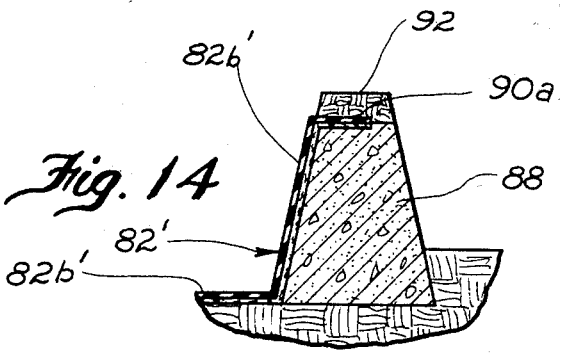
FIG. 14 is a fragmentary, sectional view taken generally along the plane of line 14—14 of FIG. 12, looking in the direction of the arrows.
Figure 15:
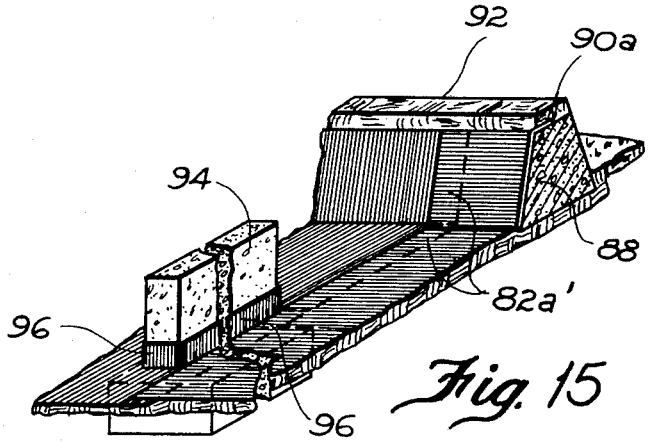
FIG. 15 is a fragmentary, generally perspective, partially broken illustration of the sectional formation of the impervious fabric liner, and the overlapping relationship of the sections thereof in the formation of the dike storage reservoir of FIG. 12.
Figure 16:
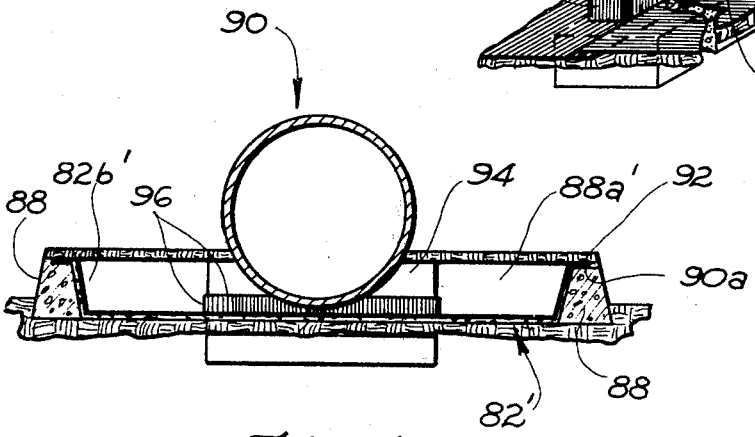
FIG. 16 is a sectional view taken generally along the plane of line 16—16 of FIG. 12, looking in the direction of the arrows.

Referring now to FIG. 11, there is disclosed another embodiment of storage reservoir 12'. In this embodiment, the reservoir is generally similar in construction to that in the FIGS. 2 and 5 embodiment except that the inlet pipe 78' for liquid from the containment reservoir 10 rather than being coupled to a pump disposed in a sump well, as in the first described embodiment, is gravity feed from the containment reservoir into the storage reservoir 12', so that the gravity causes the flow of liquid received in pipe system 64, 66 into the storage reservoir 12', until subsequently removed for, for instance, reclaiming purposes. It will be understood that such FIG. 11, system could include a well (similar to well 70 of FIGS. 1 and 7) where the fluid would pass into prior to flowing by gravity into the pipe 78', such a well aiding in settling out impurities in the liquid prior to the latter's movement, by gravity, via pipe 78' into the storage reservoir 12'.

Referring now to FIGS. 12–16 there is illustrated a further embodiment of storage reservoir 12'' which instead of being formed by a substantial excavation or pit in the ground, is formed substantially at ground level with dike walls, such as earthen or clay walls 88 disposed in encompassing relation to a reservoir space 88*a*, having a flexible liquid impervious liner 82' laid therein, and with a containment tank 90 being mounted in the lined containment space. The liner 82' forming the bottom and side wall surfaces of the reservoir, extend along the bottom surface of the containment space and up the dike walls on the interior surfaces thereof, and then run across at least a portion of the upper section of the dike wall as at 90*a*. Weight means such as the layer of dirt or soil 92 can be utilized to anchor or hold the liner in position on the dike walls. Liner 82' may be the same as or generally similar to aforediscussed liner 82 of the FIGS. 5 and 11 embodiments, and likewise may be reversed so that the rubberized or impervious layer 82*b'* faces outwardly to engage the confronting earthen surfaces, rather than facing inwardly as illustrated.

Tank 90 which may be formed of for instance metal, or of any other suitable material, supported on, in the embodiment illustrated, concrete piers 94 with the tank being surrounded by dike walls 88 encompassing the area which the tank 90 occupies. The dike and associated liner 82' is adapted to retain any liquid from the tank which overflows or spills (or in the event of bursting of the tank) to prevent such liquid from seeping into the adjacent ground areas. The stock material for the liner may be provided in strip sections disposed in overlapped relation, as at 82]a', generally similar to the FIGS. 5 and 11 embodiments. Where the liner sections meet the piers, the liner can be run up the sides and ends of the associated pier as illustrated at 96 in FIGS. 15 and 16. The liner material is able to be readily cut by sharp cutting instruments, and thus the laying of the liner of strips or rows from packages or rolls of liner stock, into the earthen reservoir dike space, is materially facilitated. The liner portions 96 extending upwardly about the piers 94 are preferably fastened by suitable adhesives to the piers to make a liquid tight connection with respect thereto, such adhesive being resistant or uneffected by the petroleum based liquids beings stored. The tank 90 may have vent pipes 98 thereon for overflow of liquid in the event that too much liquid is attempted to be inserted into the tank via its entry pipe 78, as well as means providing for venting of vapor, as for instance by vapor pipes 100. An outlet flow valve 102 may also be provided on the tank.

Figure 8:
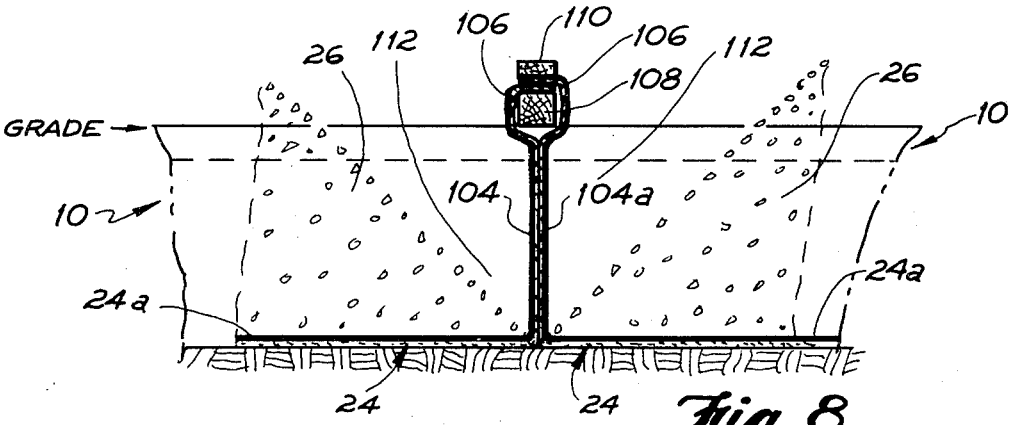
FIGS. 8 and 9 are enlarged, fragmentary, generally diagrammatic, sectional views illustrating the preferred arrangement for forming containment reservoirs, and specifically the end sections thereof, in aligned or tandem relationship with respect to one another, and filling the containment space of such containment reservoirs with ballast material, so that such containment reservoirs can be provided in any desired length series along a railroad track section.
Figure 9:
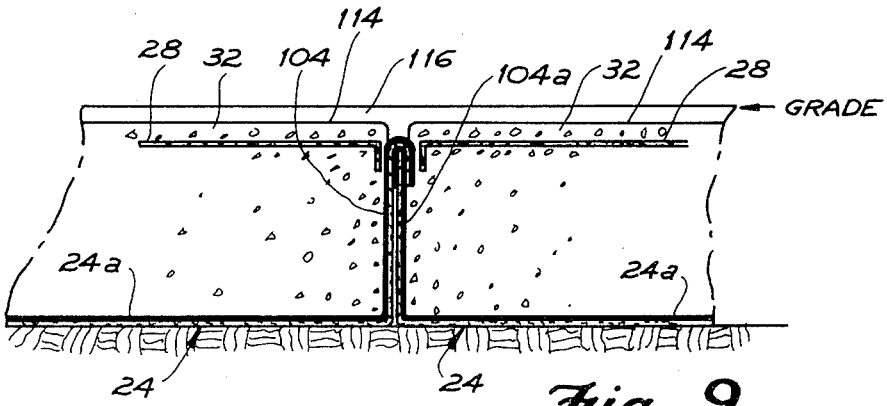
Figure 10:
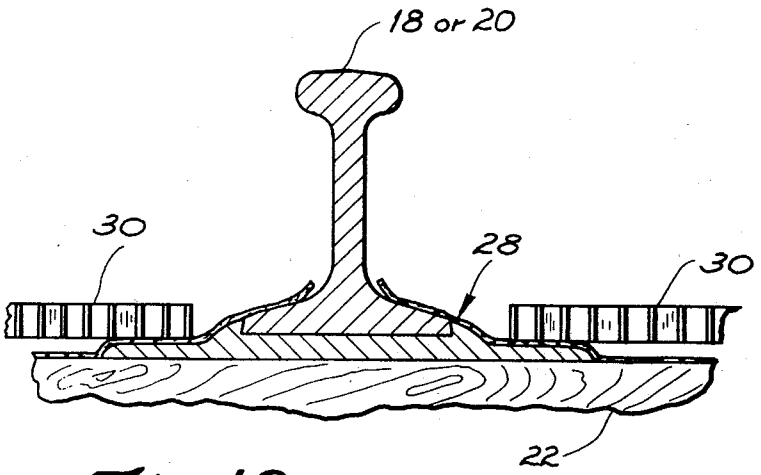
FIG. 10 is an, enlarged, transverse, vertical sectional view of one of the track members or rails of the track section, showing the relationship between the pervious fabric layer which overlies the containment space of the containment reservoir and metal grating which is utilized intermediate the rails and adjacent to the rails, to form spaced safe walking areas over oily ballast.

FIGS. 8 and 9 illustrate a method of forming the end wall portions of adjacent containment reservoir formed in aligned or tandem relation with respect to one another along a railroad track section, thus providing for any desired length of containment reservoir system irrespective of the stock material for forming the flexible reservoir liners, coming in predetermined standard lengths.

The end wall sections 104 and 104*a* of the liner 24 of the adjacent containment reservoirs may be looped, as at 106, about a transverse beam 108 extending across the excavation for the reservoir, with a top member 110 laid on beam 108 to maintain the vertical orientation of the flexible end walls, and then the ballast 26 is filled or pushed into the space 112, and against the walls, to maintain the latter's vertical condition. Beam 108 and holder member 110 can then be removed, and the distal end of the liner end walls tucked downwardly as illustrated in FIG. 9. The top porous layer 28 of fabric may then be applied to the respective reservoir ballast bed as illustrated, and maintained in position by, for instance, ballast layer 32. The upper ends of the side wall sections 114 of the liner 24 may be retained in position by the overlying earthen layer 116, similar to the first described containment and storage reservoirs.

Figure 17:
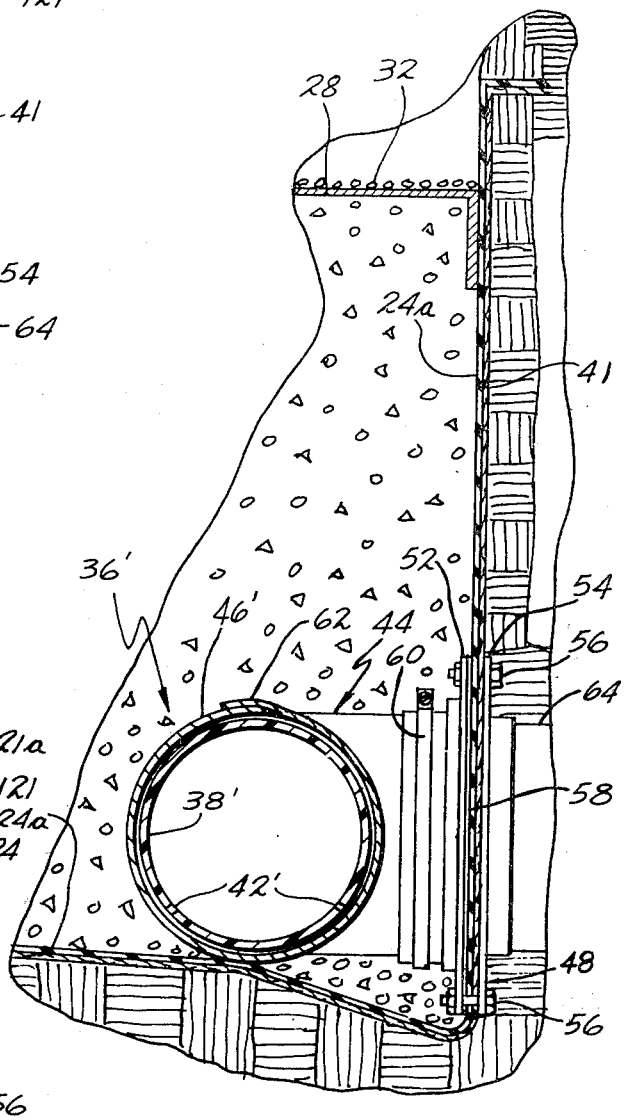
FIG. 17 is a fragmentary sectional view similar to FIG. 6, but illustrating another embodiment of drain for a containment reservoir.

Referring now to FIG. 17, there is illustrated another embodiment of drain section 36' which is somewhat similar to that (e.g. 36) of the FIG. 6 embodiment previously discussed in conjunction with FIGS. 3 through 6A. In this FIG. 17 embodiment, the pipe sections 38' which may be of plastic pipe as in the first described embodiment, are perforated only adjacent the lower portions thereof, as at 42' along the lengthwise extent of pipe sections 38', so that liquid caught in the containment reservoir drains into the perforated pipe sections 38' only at the lower portions thereof, and from whence it is removed from the containment reservoir via the T connections 44 spaced along the perforated pipe sections 38' and coupled therewith in a similar manner as disclosed in the first described embodiment of drain.

In this embodiment, the envelope 46' of pervious fabric material encompasses primarily the perforated pipe 38' in generally direct engagement therewith, and is not coupled to the fastening arrangement 48 at each T connection 44 as in the first described embodiment. Moreover, the envelope 46' is not filled with ballast as in the first described embodiment, but more or less directly engages the pipe 38' and associated section of the T coupling. Such FIG. 17 drain arrangement is generally simpler to install and yet effectively provides for removal of liquid from the containment reservoir.

Figure 18:
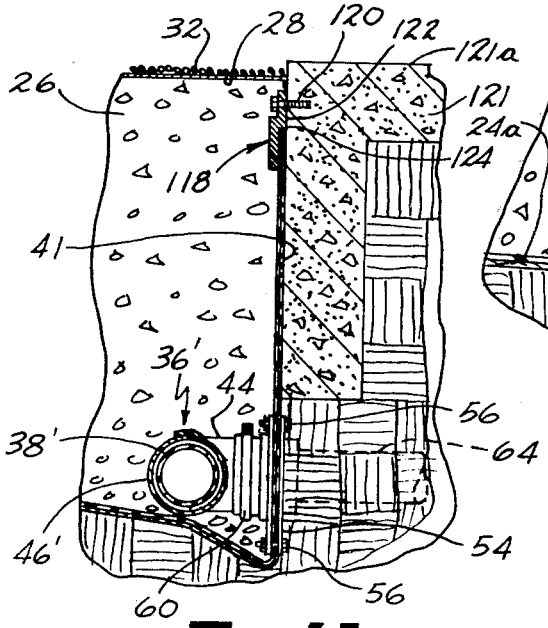
FIG. 18 is a fragmentary sectional view generally similar to FIG. 4, but embodying the drain arrangement of FIG. 17, and illustrating flashing attached to the existing side wall of the containment reservoir and coating with the side wall portion of the flexible liner, for preventing undesired leakage of liquid running into the reservoir from the top of the concrete side wall abutment.

Referring now to FIG. 18, there is disclosed a containment reservoir 10 which embodies flashing 118 running along the interior sides of the reservoir. In this arrangement, flashing 118 is secured as by means of fasteners 120 to an existing concrete abutment 121 partially defining the containment reservoir. This could occur for instance at a fueling station disposed along a railroad track section in which the top surface 121*a* of the concrete abutment 121 slopes toward the reservoir proper. Flashing 118 secured to the side of an existing concrete abutment would preferably have some sealing compound inserted, as at 122, between the flashing and the confronting abutment side surface, and the upper end 124 of the side wall section 41 of the flexible liner 14, is inserted between the flashing and the concrete abutment. Accordingly, in the event of a spill of diesel fuel or other liquid for locomotives or the like, flowing off the top surface 121*a* of the fueling station abutment 121, such fuel could not seep down between the liner 24 and the concrete abutment, but instead would be directed by the flashing 118 into the lined containment reservoir, for removal via drain 36'.

Figure 19:
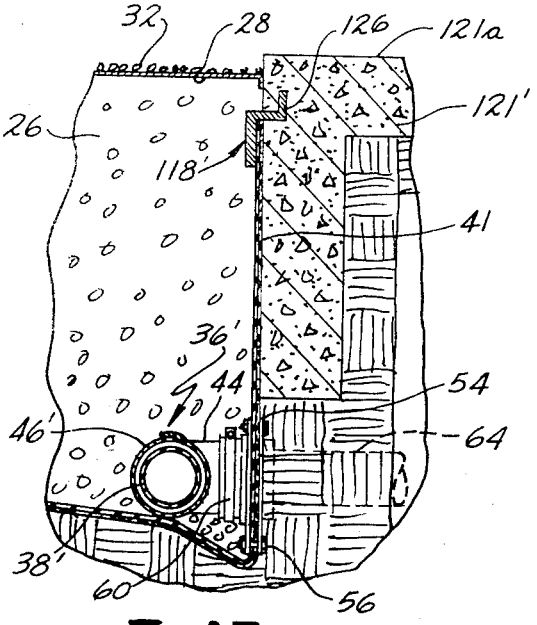
FIG. 19 is a view generally similar to that of FIG. 18, but illustrating another embodiment of flashing seal arrangement, and in an environment wherein the flashing seal is installed at the time of constructing the concrete side wall abutment of the reservoir.

In FIG. 19 there is shown a similar arrangement of flashing member 118' but in this arrangement, the flashing member has an offset section 126 which is embedded or installed in the concrete abutment 121'0 when it is initially formed, so that the flashing is integrally joined with the fueling station apron, and therefore it is not necessary to attach the same utilizing fasteners. The side wall section 41 of the flexible liner is wedged or inserted between the flashing 118' and the confronting surface of the concrete abutment 121' in the same manner as aforedescribed in connection with the FIG. 18 embodiment.

Figures 20, 21, 22, 23:
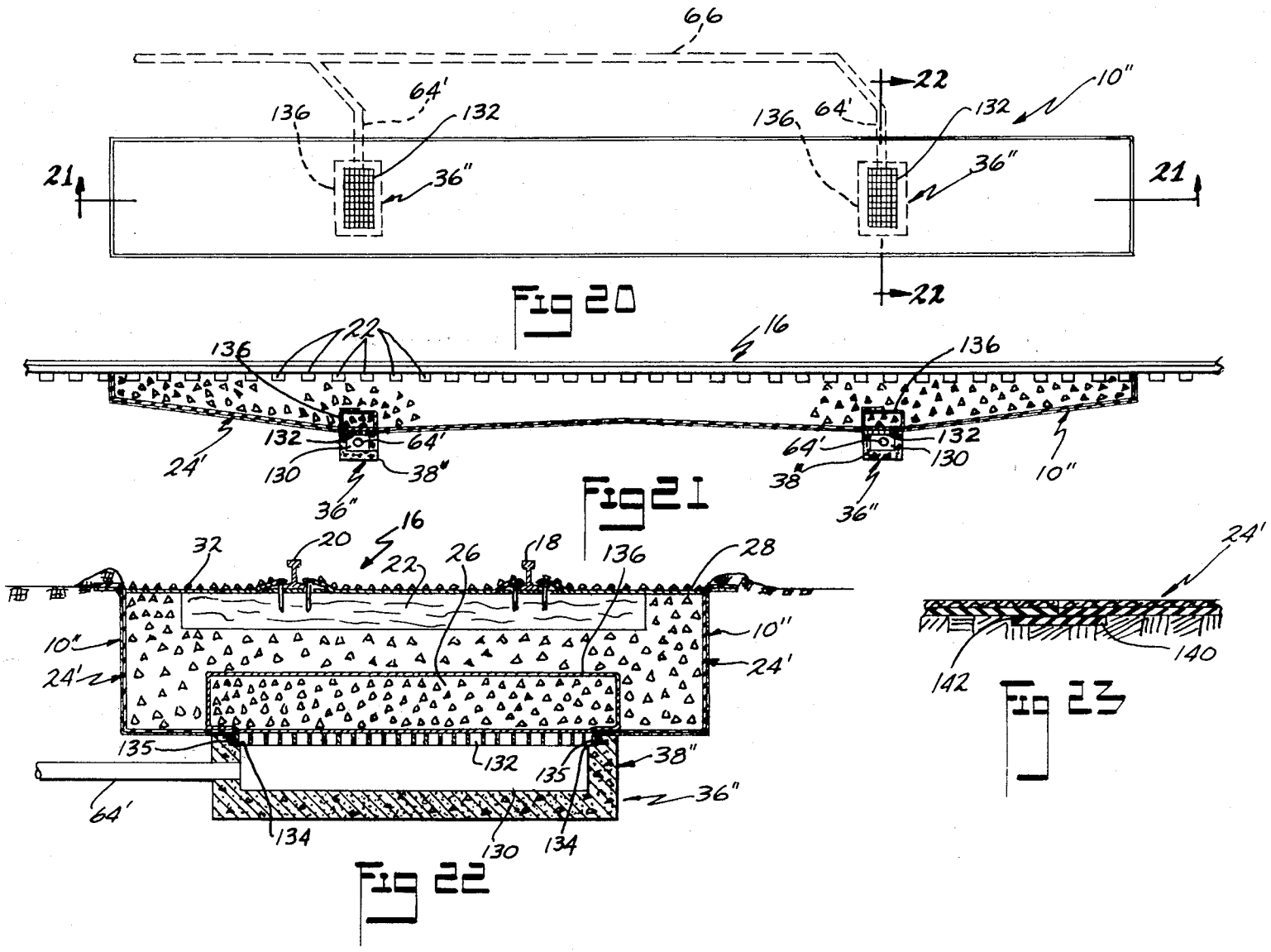
FIG. 20 is a generally diagrammatic top plan view of another embodiment of containment reservoir utilizing another form of drain, for draining liquid for the containment reservoir; the overlying railroad track has been deleted from the FIG. 20 showing.
FIG. 21 is a vertical sectional view taken generally along the plane of line 21—21 of FIG. 20 looking in the direction of the arrows, and showing the overlying railroad track section.
FIG. 22 is an enlarged vertical sectional view taken generally along the plane of line 22—22 of FIG. 20 looking in the direction of the arrows.
FIG. 23 is an enlarged vertical sectional view showing an alternate seaming arrangement for formation of predetermined size of liner for a reservoir, and one which can be accomplished at the site.

Referring now to FIGS. 20–22, there is shown an alternate form of drain 36'' for a containment reservoir of the general type illustrated in FIGS. 1 and 3. Rather than having the drain formed of perforated plastic pipe, in this embodiment the drain (or drains) is formed of concrete chamber members 38'', defining a space 130, which is adapted to receive therein the liquid from the liner formed reservoir 10''. Drain members 38'' are preferably preformed, and may be formed of concrete as shown. Members 38'' are open at the top thereof, with such open top being covered over by a grating 132 formed of any suitable material, such as for instance metal or plastic. The grating member 132 rests on shoulders 134 provided in drain member 38'', so that the grating in effect forms a general continuation of the bottom surface of the containment reservoir as defined by the flexible liner 24'. As can be seen in FIG. 22, the bottom defining wall of the liner 24' is tucked as at 135 into the space between the grating 132 and the confronting surface of the drain member 38'' and thus is securely held therein in anti-leak relation.

In order to prevent or inhibit clogging of the openings in grating 132 for long and expeditious passing of liquid therethrough, there is preferably provided an envelope or enclosure 136 formed of liquid porous material, which may be of the same general type and composition as that of the top layer 28 covering the top of the containment reservoir, with the envelope defining an enclosure in which is received ballast material 26. The ballast filled envelope 136 covers the grating surface in overlapping relation (FIG. 22) and aids in preventing fines from clogging the openings in the grating 132. A pipe 64' is coupled to each of the drain members 38'', as can be best seen from FIGS. 20 and 22, and communicates with pipe passage 66 in a similar manner as in the first described FIG. 1 system, for transfer of the liquid from the containment reservoir to a storage reservoir. The structural arrangement of the remainder of the containment reservoir may be generally similar to that of the first described embodiment illustrated in FIGS. 1 through 3. It will be seen that liquid flowing down an inadvertent spill from vehicles positioned on the track section 16 disposed above the containment reservoir, will filter down through the containment reservoir top pervious layer 28 into the reservoir chamber and then into and through the envleope 136 and associated ballast, and then through the grating 132 into the drain member 38'' from whence it will flow by gravity out through pipe 64'.

Referring to FIG. 23, there is illustrated a liner of the multi-layer type aforediscussed in connection with the other embodiments, and wherein the strips of the liner material can be adhered to one another by a resilient joint 140 which can be secured by suitable known adhesives as at 142, and, such as rubber bonding adhesives, to the junction between adjacent strips of the liner material, to provide a continuous selected width of liner. The seaming of liner strips can be readily accomplished in the field to thus facilitate the building of desired sizes of reservoirs.

From the foregoing discussion and accompanying drawings it will be seen that the invention provides a novel arrangement or system for catching and storing liquids along railroad track section, and a system formed of a flexible liner containment reservoir, a flexible liner storage reservoir, and means coacting between the containment and storage reservoirs for transferring liquid caught in the containment reservoir to a storage reservoir. The invention also provides a system of the above type which includes drain structure including a filtering means coacting in certain embodiments with perforated drain pipe for removing liquid from the containment reservoir, and coacting in another embodiment with a formed drain chamber including perforated means for supporting filtering means thereon, with the filtering means resisting the transmittal of contaminants to the drain pipe or to the drain chamber. The invention also provides a novel method of collecting and storing liquids such as petroleum based oils, along a railroad track section environment or the like.

The terms and expressions which have been used are used as terms of description and not of limitation, and there is no intention in the use of such terms and expressions of excluding any equivalents of any of the features shown, or described, or portions thereof, and it is recognized that various modifications are possble within the scope of the invention claimed.

What is claimed is:

1. A method of collecting and storing liquids, such as petroleum based oil, from along a railroad track section, comprising, providing a containment reservoir adjacent to and beneath the track section, said reservoir including a flexible liquid impervious liner defining a containment space for collecting the liquid in the reservoir and preventing its escape into adjacent land areas, said liner comprising a layer of liquid pervious fabric material having on at least one of its sides an attached layer of liquid impervious material, such as rubber which is resistant to oil degradation, providing a relatively coarse particle bed located on said liner to generally fill said containment space, providing a layer of liquid pervious flexible fabric filter material covering the open top of said bed for preventing contaminant material of predetermined size from entering said bed, providing drain means including an apertured drain member for removing liquid from said reservoir and conduit means coacting in liquid communicating relation with said drain member generally adjacent the lowermost level of said containment space, extending said conduit means through the reservoir wall defined by said liner, providing a filter in coacting relation with said drain member and filtering liquid passing thereinto from the containment space, providing sealing means coacting between said liner and said conduit means for preventing inadvertent escape of liquid into the adjacent land areas past said liner at said location of extension of said conduit means through the reservoir wall, providing a storage reservoir in spaced relation to said containment reservoir, and transferring liquid collected in said containment reservoir from the latter via said drain means to said storage reservoir.

2. A method in accordance with claim 1, wherein said transferring is accomplished by automatically pumping the liquid collected from said containment reservoir, to said storage reservoir.

3. A method in accordance with claim 1, wherein said transerring is accomplished by automatic gravity flow of liquid from said containment reservoir to said storage reservoir.

4. A method in accordance with claim 1, wherein said drain member comprises a perforated pipe running lengthwise of said containment reservoir along the lowermost portion thereof and including collecting the liquid caught in said containment reservoir, in said perforted pipe including passing the liquid through a liquid pervious layer of non-woven fabric material coacting with such pipe and comprising said filter, generally just prior to the liquid being received in the pipe.

5. A method in accordance with claim 1, wherein said filter coacting with said drain member includes a liquid pervious layer of non-woven fabric material through which the liquid from the containment space is passed as it travels into the drain member, and including providing a layer of ballast intermediate the last mentioned fabric layer and said drain memer through which the liquid from the containment space is passed prior to being received in said drain member.

6. A method in accordance with claim 1, wherein said sealing means comprises a deformable liquid impervious sleeve, and including clamping said sleeve to said conduit means and to said liner in sealed relation therewith for preventing said inadvertent escape of liquid at the location of extension of said conduit means through the reservoir wall.

7. A method in accordance with claim 1, including providing a series of said reservoirs in tandem relation beneath the track section, and transferring liquid collected in each of said tandem arranged reservoirs to said storage reservoir via respective drain means of said tandem arranged reservoirs.

8. A method in accordance with claim 1, including laying said liner in the reservoir so that said liquid impervious layer faces inwardly of the containment space.

9. A method in accordance with claim 1, including collecting the liquid caught in said containment reservoir, via said drain means, in a formed drain chamber disposed below the lowermost portion of said containment reservoir and then removing such liquid from the chamber to said storage reservoir.

* * * * *